United States Patent [19]

McWilliams

[11] 4,278,179

[45] Jul. 14, 1981

[54] CONTAINER CLOSURE

[76] Inventor: Richard L. McWilliams, 1310 McCullough, San Antonio, Tex. 78212

[21] Appl. No.: 101,643

[22] Filed: Dec. 10, 1979

[51] Int. Cl.³ ..... B65D 51/04

[52] U.S. Cl. ..... 215/245; 222/498; 222/558

[58] Field of Search ..... 215/237, 244, 245; 222/498, 558; 220/306

[56] References Cited

U.S. PATENT DOCUMENTS

| | | | |
|---|---|---|---|
| 1,850,606 | 3/1932 | Smith | 222/498 X |
| 1,977,302 | 10/1934 | Brill | 222/558 X |
| 2,153,245 | 4/1939 | Gansz | 222/558 X |
| 2,247,357 | 7/1941 | Brus | 222/498 |

*Primary Examiner*—Donald F. Norton

*Attorney, Agent, or Firm*—Gale R. Peterson

[57] ABSTRACT

A container closure lid and container dispensing top including a container dispensing top and a closure lid pivotally mounted on the container top and movable between an open position and a closed sealing position. The container lid further includes elongated serations disposed in an opposing relationship such that upon closure the serations will mate and form a multiple lock. The container lid is pivotally mounted to the container top through pivot points below the closure surface of the container top and the container top closure surface is generally inclined downwardly toward the pivot points.

2 Claims, 7 Drawing Figures

CONTAINER CLOSURE

BACKGROUND OF THE INVENTION

The present invention relates generally to material dispensing devices and more particularly to a safety closure means on a dispensing type closure.

Dispensing closures for use on containers are well known in the prior art. Two examples of such closures are shown in U.S. Pat. No. 4,047,495 issued to Edwin D. O'Brian and Re 29793 issued to Harold T. Pehr. As shown in these two patents, numerous attempts have been made to provide a closure apparatus which will effectively dispense material from the container.

One of the objects of the present invention is to provide a simple but effective means of sealing and locking a pivoted releasable closure member mounted on a container top portion. Another object of the invention is to provide a closure member which may be easily released as desired while at the same time effectively securing the closure member to the top portion. Another object of the invention is to provide a dispensing closure member with a sealing means to prevent leakage of material from the container during storage or shipping. Other objects of the invention will be apparent from the following description of the invention.

SUMMARY OF THE INVENTION

A safety dispensing container closure apparatus, having a top portion which is normally secured to a container opening with an aperture extending through the top portion, communicating with the container opening for dispensing material through the aperture from the container. The top portion includes a closure surface which is inclined relative to the aperture and a closure member is pivotally secured with the container top portion. The closure member has a second closure surface for sealing engagement with the closure surface on the top portion. The closure member includes narrowly extending spaced leg members positioned at opposed sides of the top portion to position the pivot point for the closure member below the sealing surfaces. Opposed latching means provide a releasable latch securing the closure member in sealing relationship with the top portion. The latch members may be formed of resilient material to allow them to be releasably engaged and include latching surfaces inclined downwardly at an acute angle toward the pivot point of the top portion. The sealing surfaces are likewise inclined downwardly toward the pivot point of the top portion.

DESCRIPTION OF THE PREFERRED EMBODIMENT

Figure 1:
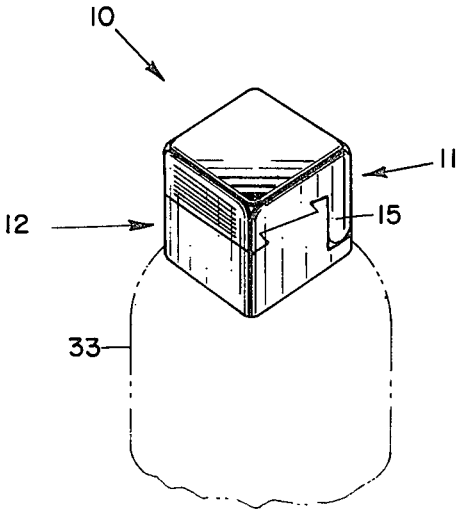
FIG. 1 is a perspective view of the dispensing closure apparatus in its closed position.
Figure 5:
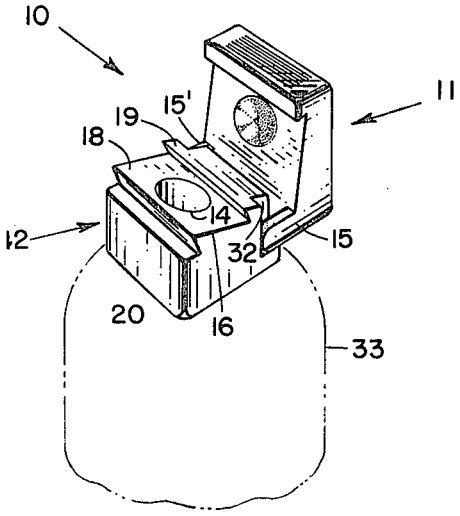
FIG. 5 is a perpsective view of the dispensing closure apparatus in its open dispensing position.
Figure 2:
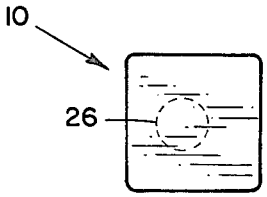
FIG. 2 is a top view of the dispensing closure apparatus with a dispensing aperture and plug seal shown in phantom lines.
Figure 6:
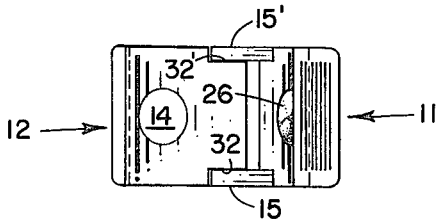
FIG. 6 is a top view of the dispensing closure apparatus in its open position.

In the drawing there is shown a container closure apparatus 10 including a container top portion 12 and a container closure member 11. Container top portion 12 has a dispensing aperture 14 extending thereto and in full communication with the mouth of dispensing container 33. Thus, container top portion 12 is adapted for mounting on a container opening and aperture 14 communicates with the interior of container 33 through the mouth thereof for dispensing material from the container. The size and shape of the dispensing aperture is determined primarily on the nature of the dispensing material. In other words, if the dispensing material is in thin liquid form, dispensing aperture 14 may be relatively small. On the other hand, dispensing aperture 14 may be somewhat larger if dispensing material is a granular material. Also, multiple apertures may be provided, for example, for dispensing powder or liquid in multiple streams.

The dispensing material is not limited to fluids, powder, or granular materials. Disposable, pre-moistened tissues or towelettes may also be dispensed. The aperture should accordingly be sized and shaped to accompany such dispensing material.

Figure 3:
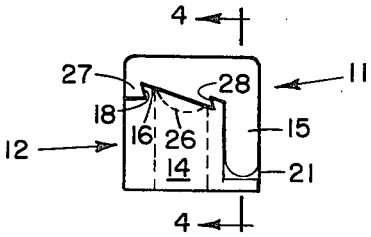
FIG. 3 is a side view of the dispensing closure apparatus in its closed position with the dispensing aperture and sealing plug shown in phantom lines.
Figure 4:
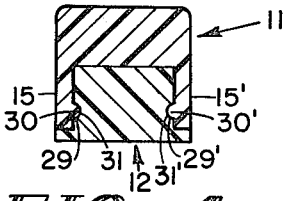
FIG. 4 is a rear view of the dispensing closure apparatus showing the pivotal attachment points.
Figure 7:
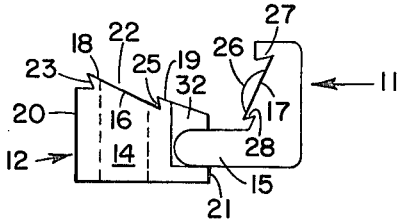
FIG. 7 is a side view of the dispensing closure apparatus in its open position with the dispensing aperture shown in phantom lines.

Container top portion 12 has a closure surface 16 having first and third latch members 18 and 19. As best shown in FIG. 3 and FIG. 7, first closure surface 16 is generally inclined downwardly at an acute angle from the front 20 of container top portion 12 to the rear 21 thereof. As shown in the drawing, latch members 18 and 19 are in the form of serations and are formed in the first closure surface 16. As clearly shown in FIG. 7, seration 18 is formed by inclined latching surface 23. Similarly, seration 19 is formed by inclined latching surface 25. The latching surfaces 23 and 25 are both inclined downwardly at an acute angle toward the pivot point 30 of the container closure member 11. Dispensing aperture 14 is preferably disposed between serations 18 and 19. The serations thereby provide a secure lock on either side of the aperture to seal the closure member with the top portion.

Container closure member 11 has a second closure surface 17 having serations 27 and 28 formed therein. Serations 27 and 28 which are in opposed relationship and form first and second latch members which releasably connect with third and fourth latch members 18 and 19. As most clearly seen in FIG. 3, upon closure opposing locking members 27 and 18 releasably connect and opposing locking members 28 and 19 likewise releasably connect. The mating of these locking members on both sides of aperture 14 provide a multiple lock around the aperture.

Container closure member 11 is hinged to container top portion 12 through two leg members 15 and 15'. Leg members 15 and 15' extend downwardly from second closure surface 17 of the closure member 11 and are pivotally attached to the container top portion 12 at pivot points 29 and 29' may be accomplished by any well known pivotal attaching means. A simple effective means of attachment is to form small spherical projections 30 and 30' on the inside surfaces of leg members 15 and 15' respectively for a snap-like insertion in mating spherical indentions 31 and 31' formed at container top portion 12. Such arrangement requires that leg members 15 and 15' be slightly resilient so that they might be positioned with the spherical projections mating with the spherical indentions. Recesses 32 and 32' are formed in the sides of container top portion 12 for receiving leg members 15 and 15'. The benefits of such recesses are that the exterior surfaces of the closure are maintained smooth, aesthetically pleasing and easily cleaned.

Container closure member 11 also has formed on the closure surface 17 a plug 26 which mates with dispensing aperture 14 for sealing engagement therewith. Plug 26 is preferably semi-spherical which has the property of effectively sealing the aperture 14 and not inhibiting the pivoting movement of the closure member 11 with respect to the top portion 12.

The length of leg members 15 and 15' is specifically chosen so as to provide secure latching of latch members 28 and 27 with latch members 18 and 19. An arcuate movement of the closure member 11 relative to the top portion 12 allows the latch members to move into engaging position with minimum distortion of the latching surfaces. The pivot points 29 and 29' are below the plane of closure surface 16 and provide an effective lock for the mating latching members upon engagement. The distortion is provided by forming closure member 11 and container top portion 12 of slightly flexible material.

When the container closure member 11 is moved from its open position as shown in FIG. 7 to its closed position as shown in FIG.3, some distortion of the latching members must occur. The positioning of the pivot axis 29 and 29' below the sealing surfaces and latching members provides a specific relationship between the latching members so as to facilitate their mating engagement. The latching members 27 and 28 are being moved to the left as shown in FIG.7 at the same time they are coming downwardly so facilitate their latching with members 18 and 19 respectively with minimal distortion. The closure member 11 is retained in secure locking position with the sealing surfaces engaged to prevent spilling from aperture 14 and accidental disengagement of the latching members. The angles of the latching members and closure surfaces are specifically chosen in relation to their pivot points 29 and 29' so as to provide the unique locking and sealing function of the apparatus.

While there has been shown and described a preferred embodiment of a SAFETY DISPENSING CONTAINER CLOSURE APPARATUS in accordance with the invention, it will be appreciated that many changes and modifications may be made therein without, however, departing from the essential spirit of the invention within the scope of the claims.

I claim:

1. A container closure apparatus, comprising:

a container top portion for mounting on a container opening having an aperture extending there through communicating with the container opening for dispensing material from the container;

said container top portion having a first closure surface inclined downwardly from the front of said container top portion to the rear thereof, and having first and third latch means in the form of serations formed on said first closure surface and extending laterally thereacross, said aperture being disposed between said first and third latch members;

a closure member pivotally secured to the container top portion and having a second closure surface for sealing engagement with the first closure surface;

said closure member having second and fourth latch means in the form of serations formed on said second closure surface and extending laterally thereacross, and in opposing relation to said first and third latch means for releasably latching with said first and third latch means thereby securing the first and second closure surfaces in sealing relationship; and said closure member having two spaced downwardly extending leg members positioned at opposed sides of said closure member for pivotally engaging said container top portion at pivot points spaced below said first closure surface and at the rear of said container top portion wherein the length of the said two leg members is chosen so as to provide a low arcuate movement of the closure member with respect to the container top portion and to securely latch said first and third latch means and said second and fourth latch means and retain said closure surfaces in sealing relationship.

2. The apparatus as set forth in claim 1, wherein:

the second closure surface includes a plug member cooperating with said aperture to provide a seal therewith.

* * * * *